US009206002B2

(12) United States Patent
Fukita et al.

(10) Patent No.: US 9,206,002 B2
(45) Date of Patent: Dec. 8, 2015

(54) SHEET FEEDING APPARATUS AND IMAGE FORMING APPARATUS

(71) Applicant: CANON KABUSHIKI KAISHA, Tokyo (JP)

(72) Inventors: Taku Fukita, Toride (JP); Akira Kuroda, Numazu (JP); Yoshiyuki Yamazaki, Fujisawa (JP); Noritomo Yamaguchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/384,189

(22) PCT Filed: Mar. 29, 2013

(86) PCT No.: PCT/JP2013/060417

§ 371 (c)(1),
(2) Date: Sep. 10, 2014

(87) PCT Pub. No.: WO2013/151149

PCT Pub. Date: Oct. 10, 2013

(65) Prior Publication Data

US 2015/0042033 A1 Feb. 12, 2015

(30) Foreign Application Priority Data

Apr. 5, 2012 (JP) ..... 2012-086032

(51) Int. Cl.
*B65H 3/06* (2006.01)
*B65H 1/12* (2006.01)
(Continued)

(52) U.S. Cl.
CPC ..... *B65H 3/0669* (2013.01); *B65H 1/12* (2013.01); *B65H 1/14* (2013.01); *B65H 3/0607* (2013.01); *B65H 3/0684* (2013.01); *B65H 5/068* (2013.01); *B65H 7/20* (2013.01); *B65H 2402/542* (2013.01); *B65H 2403/421* (2013.01); *B65H 2403/512* (2013.01); *B65H 2403/725* (2013.01); *B65H 2404/1112* (2013.01)

(58) Field of Classification Search
CPC ..... B65H 3/06; B65H 3/0607; B65H 3/0669; B65H 3/0684; B65H 2403/40; B65H 2403/51; B65H 2403/514; B65H 2403/82
USPC ..... 271/114, 117, 118
See application file for complete search history.

(56) References Cited

U.S. PATENT DOCUMENTS 4,717,139 A * 1/1988 Sootome et al. ..... 271/116
5,358,230 A * 10/1994 Ikemori et al. ..... 271/114

(Continued)

FOREIGN PATENT DOCUMENTS

JP 03102019 A 4/1991
JP 10153247 A 6/1998

(Continued)

OTHER PUBLICATIONS

International Search Report issued in International Application No. PCT/JP2013/060417 dated Jul. 9, 2013.

(Continued)

*Primary Examiner* — David H Bollinger
(74) *Attorney, Agent, or Firm* — Fitzpatrick, Cella, Harper & Scinto

(57) ABSTRACT

A variable speed unit is driven by a drive unit to make a tooth-missing large gear of a sheet feed tooth-missing stage gear mesh with a small gear of an input stage gear rotating at a constant speed, to then rotate a rotating shaft of the feeding roller and a cam at a first speed to lift an intermediate plate. If a sheet stacked on the intermediate plate is pressed against the feeding roller, the variable speed unit makes a large gear of the input stage gear and a tooth-missing small gear of the sheet feed tooth-missing stage gear mesh with each other, so that the rotating shaft of the feeding roller is rotated at a second speed faster than the first speed to rotate the feeding roller at a fast speed.

8 Claims, 10 Drawing Sheets

(51) Int. Cl.

| | |
|---|---|
| ***B65H 1/14*** | (2006.01) |
| ***B65H 5/06*** | (2006.01) |
| ***B65H 7/20*** | (2006.01) |

(56) References Cited

U.S. PATENT DOCUMENTS

| | | | | |
|---|---|---|---|---|
| 5,621,451 | A | 4/1997 | Sugiura et al. | |
| 5,907,745 | A | 5/1999 | Azuma et al. | |
| 6,070,867 | A | 6/2000 | Tsurumi et al. | |
| 6,308,947 | B1 | 10/2001 | Kojima et al. | |
| 6,502,816 | B2 | 1/2003 | Inoue et al. | |
| 8,210,528 | B2 | 7/2012 | Yamaguchi | |
| 8,439,349 | B2 | 5/2013 | Matsumoto et al. | |
| 8,550,455 | B2 | 10/2013 | Yamaguchi | |
| 8,684,346 | B2 | 4/2014 | Yamazaki et al. | |
| 8,720,886 | B2 | 5/2014 | Kuroda et al. | |
| 8,870,182 | B2 | 10/2014 | Ogata et al. | |
| 2008/0169599 | A1* | 7/2008 | Lam et al. | 271/114 |
| 2009/0008868 | A1* | 1/2009 | Kuroda | 271/162 |
| 2013/0216291 | A1 | 8/2013 | Fukusaka et al. | |
| 2014/0047935 | A1* | 2/2014 | Gaarder et al. | 74/55 |

FOREIGN PATENT DOCUMENTS

| | | | |
|---|---|---|---|
| JP | 2000118768 | A | 4/2000 |
| JP | 2001097579 | A | 4/2001 |
| JP | 2002167062 | A | 6/2002 |
| JP | 2004083167 | A | 3/2004 |

OTHER PUBLICATIONS

International Search Report issued in counterpart International Application No. PCT/JP2013/060417, dated Oct. 16, 2014.

* cited by examiner

SHEET FEEDING APPARATUS AND IMAGE FORMING APPARATUS

TECHNICAL FIELD

The present invention relates to a sheet feeding apparatus and an image forming apparatus, and particularly, to a configuration for reducing the noise when a sheet abuts against a feeding roller during sheet feeding.

BACKGROUND ART

In the related art, image forming apparatuses, such as copying machines and printers, includes a sheet feeding apparatus that feeds out a sheet toward an image forming unit. Such a sheet feeding apparatus includes a liftable intermediate plate, and a feeding roller, and is adapted to lift the intermediate plate by the rotation of the feeding roller to press a sheet on the intermediate plate against the feeding roller, and feed out the sheet as the feeding roller rotates in this state.

Here, as a configuration for lifting the intermediate plate by the rotation of the feeding roller in this way, for example, there are those adapted to fix a cam to a rotating shaft of the feeding roller and to bring this cam into pressure contact with a pressure-contact portion provided at the intermediate plate biased by a spring (refer to Japanese Patent Application Laid-Open No. H3-102019 and Japanese Patent Application Laid-Open No. H10-153247). If a feeding operation starts, the intermediate plate is lifted by the rotation of the cam while opening the spring pressure of a spring that biases the intermediate plate, and a sheet on the intermediate plate is the pressed against the feeding roller.

Incidentally, in such a sheet feeding apparatus of the related art, the ascending speed when the intermediate plate ascends by the rotation of the cam is determined depending on the force of the spring that biases the intermediate plate and the outer peripheral shape (profile) of the cam. Additionally, the ascending speed of the intermediate plate, in other words, the speed at which the top sheet of the stacked sheets abuts against the feeding roller varies depending on the stack amount of the sheets on the intermediate plate, and the speed in a case where the stack amount is small increases more than the speed in a case where the stack amount is large. In a case where the speed at which the top sheet abuts against the feeding roller in this way has increased, an abutment sound (collision sound) is generated when the sheet abuts against the feeding roller.

Here, in order to reduce this abutment sound (collision sound), the rotating speed of the cam, in other words, the rotating speed of the feeding roller may be made slow to make the ascending speed of the intermediate plate slow. In addition, in a case where the rotating speed of the feeding roller is made slow, there is a concern that an image cannot be suitably formed on a sheet. After this, however, if the rotating speed of the feeding roller is increased to the printing speed (process speed) of the image forming apparatus, an image can be suitably formed on a sheet.

However, in order to allow such speed control, it is necessary to drive the feeding roller by a dedicated driving source. However, generally, a driving source often serves also as other driving sources of an image forming system and a conveyance system. In this case, the feeding roller cannot be rotated only at a constant speed. For this reason, only the rotating speed of the feeding roller cannot be made slow, and if the printing speed increases, the rotating speed of the feeding roller increases and the ascending speed of the intermediate plate also increases correspondingly.

That is, in the sheet feeding apparatus of the related art, the driving source of the feeding roller serves as other driving sources. Thus, it is not possible to arbitrarily change the rotating speed of the rotating shaft to abate the abutment sound. For this reason, although the elevating speed of the intermediate plate depends on the profile of the cam, there is a limit of sufficiently securing the reduction region of the ascending speed of the intermediate plate only by the outer peripheral shape of the cam.

Thus, the invention has been made in view of these circumstances, and an object thereof is to provide a sheet feeding apparatus and an image forming apparatus that can reduce the collision sound when a sheet abuts against a feeding roller and suitably form an image on the sheet.

SUMMARY OF INVENTION

Technical Problem

A sheet feeding apparatus of the invention includes a liftable sheet stacking plate that supports a sheet; a feeding roller that is provided above the sheet stacking plate and feeds the sheet supported by the sheet stacking plate; a biasing unit that biases the sheet stacking plate in a direction of the feeding roller and presses the sheet stacked on the sheet stacking plate against the feeding roller; a drive unit that generates a driving force in order to rotate a shaft of the feeding roller; a lifting and lowering unit that has a cam provided on the shaft of the feeding roller and a pressure-contact portion that is provided at the sheet stacking plate and is brought into pressure contact with the cam that lifts and lowers the sheet stacking plate biased by the biasing unit with the rotation of the shaft of the feeding roller while bringing the pressure-contact portion into pressure contact with the cam; and a variable speed unit that changes the rotating speed of the shaft of the feeding roller that rotates under the driving of the drive unit. The variable speed unit rotates the shaft of the feeding roller at a first speed to lift the sheet stacking plate, and rotates the shaft of the feeding roller at a second speed faster than the first speed if the sheet stacked on the sheet stacking plate abuts against the feeding roller.

Further features of the present invention will become apparent from the following description of exemplary embodiments with reference to the attached drawings.

DESCRIPTION OF EMBODIMENTS

Figure 1:
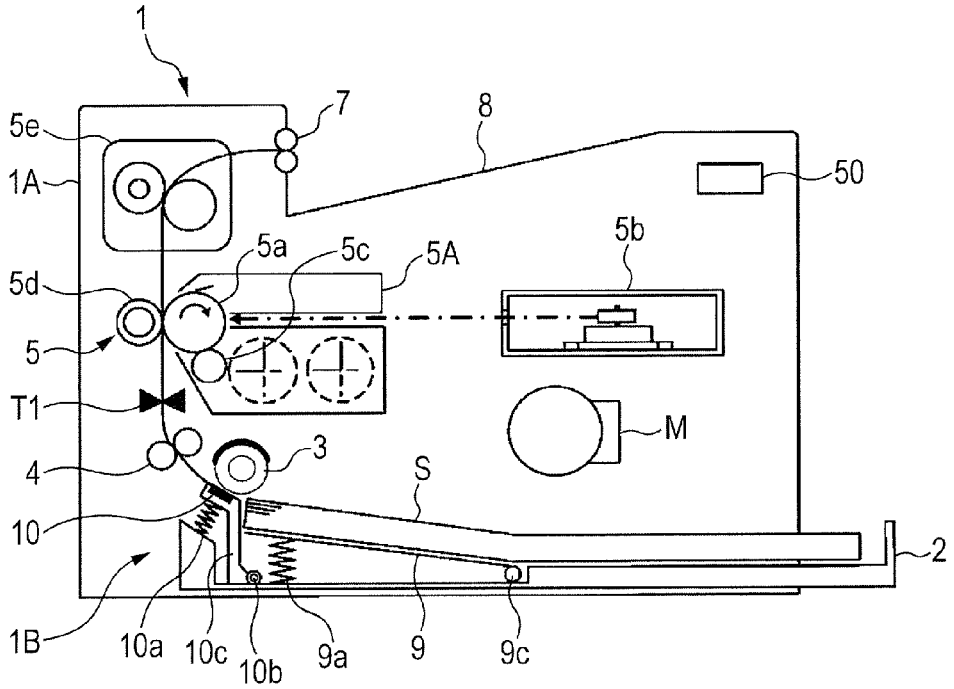
FIG. 1 is a view illustrating the schematic configuration of a printer that is an example of an image forming apparatus including a sheet feeding apparatus related to a first exemplary embodiment of the invention.

Hereinafter, exemplary embodiments of the invention will be described in detail with reference to the drawings. FIG. 1 is a view illustrating the schematic configuration of a printer that is an example of an image forming apparatus including a sheet feeding apparatus related to a first exemplary embodiment of the invention. In FIG. 1, reference numeral 1 represents a printer, reference numeral 1A represents a printer body that is an apparatus body, reference numeral 5 is an image forming unit that is provided in a printer body 1A and performs image formation by an electrophotographic method, and reference numeral 1B represents a sheet feeding apparatus that feeds a sheet S to the image forming unit 5.

Here, the image forming unit 5 includes a laser exposure device 5*b*, a photoconductive drum 5*a* that forms a toner image, and a transfer roller 5*d* that transfers the toner image formed on the photoconductive drum 5*a* to a sheet S. In addition, reference numeral 5A represents a process cartridge including the photoconductive drum 5*a*, a developing unit 5*c*, or the like, and the process cartridge 5A is detachably mounted on the printer body 1A.

The sheet feeding apparatus 1B includes a feeding roller 3, a sheet feed tray 2 that is a sheet storage unit, and an intermediate plate 9 that is a sheet stacking plate that is liftably provided at the sheet feed tray 2 and presses sheets S stored in the sheet feed tray 2 to the feeding roller 3. Additionally, a separation pad 10 brought into pressure contact with the feeding roller 3 is provided on the downstream side of the sheet feed tray 2 in a sheet feeding direction.

In such a sheet feeding apparatus 1B, when an image is formed, sheets S are fed out from the sheet feed tray 2 by the feeding roller 3, and then, the sheets S are separated one by one by the separation pad 10 brought into pressure contact with the feeding roller 3. In addition, the separation pad 10 is held at a turning end of a separation pad holder 10*c* that has a turning fulcrum 10*b* below the intermediate plate 9, and is biased toward the feeding roller 3 by a coil spring 10*a*.

Next, an image forming operation in the printer 1 of such a configuration will be described. If the image forming operation is started, first, the feeding roller 3 rotates and the intermediate plate 9 ascends with the rotation of the feeding roller 3. Then, sheets S stacked on the intermediate plate 9 are pressed against the feeding roller 3, and the sheets S are then fed out by the rotation of the feeding roller 3. Next, the sheets S are separated one by one by the separation pad 10 and conveyed by a conveying roller pair 4. Thereafter, if the tip of a sheet S is detected by a sensor T1, a laser beam according to an image signal is irradiated from the laser exposure device 5*b* to the photoconductive drum 5*a* that has a surface subjected to a charging treatment and that is rotationally driven in the direction of an arrow.

Then, as the light according to such an image signal is irradiated, a latent image is formed on the photoconductive drum, and the latent image on the photoconductive drum is developed with toner supplied by the developing unit 5*c*, and is visualized as a toner image. Thereafter, if the sheet S is conveyed to a transfer unit formed by the transfer roller 5*d* and the photoconductive drum 5*a*, the visualized toner image is transferred to the sheet S by applying a voltage, which has polarity reverse to the toner image formed on the photoconductive drum 5*a*, to the transfer roller 5*d*.

Next, the sheet S on which the toner image has been transferred is conveyed to a fixing unit 5*e* arranged at an upper part of the printer body. Then, when passing through the fixing unit Se, the transferred toner image is fixed on the sheet as heat and pressure is applied to the sheet S. Thereafter, the sheet S on which the toner image has been fixed is conveyed by a discharge roller pair 7 and discharged to a discharge unit 8 formed on the top face of the printer body 1A. In addition, in FIG. 1, symbol M represents a main motor as a drive unit that generates a driving force in order to rotate the feeding roller 3 or the like. The driving of the main motor M is transmitted to the feeding roller 3, the conveying roller pair 4, the photoconductive drum 5*a*, the fixing unit 5*e*, and a sheet ejection roller pair 7 via a driving transmission unit, such as a driving gear train. Additionally, in FIG. 1, reference numeral 50 represents a control unit that controls the operation of the main motor M, and a solenoid 14 or the like to be described below.

Figure 2:
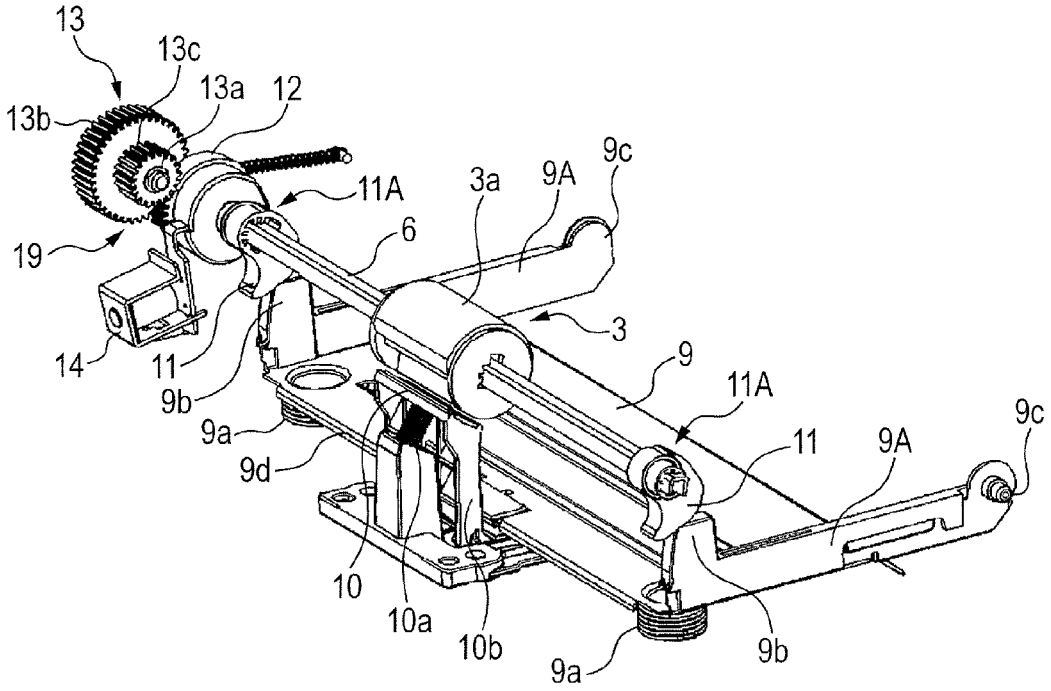
FIG. 2 is a view illustrating the configuration of the sheet feeding apparatus related to the first exemplary embodiment of the invention.

Here, in the present exemplary embodiment, the feeding roller 3 of the sheet feeding apparatus 1B, as illustrated in FIG. 2, has a configuration in which a rubber portion 3*a* in which a portion of a circumference surface is cut out is fixed to a rotating shaft 6. Additionally, the intermediate plate 9 is vertically turnably supported on the sheet feed tray 2 via fulcrums 9*c* provided on the upstream side in the sheet feeding direction of side wall portions 9A vertically provided at both ends in a width direction orthogonal to the sheet feeding direction, and sheets are set on the intermediate plate such that the tips thereof are aligned with the turning end 9*d* of the intermediate plate 9. Additionally, the intermediate plate 9 is biased toward the feeding roller 3 by coil springs 9*a* that are biasing members arranged below both ends in the width direction on the downstream side in the sheet feeding direction.

Cams 11 are fixed to both ends of the rotating shaft 6 in the width direction, and pressure-contact portions 9*b* that abut against the right and left cams 11, respectively, are formed on the top faces of the side wall portions 9A of the intermediate plate 9 on the downstream side in the sheet feeding direction. Then, as the rotating shaft 6 rotates and the cams 11 rotate, the intermediate plate 9 ascends and descends. That is, in the present exemplary embodiment, a lifting and lowering unit 11A that lifts and lowers the intermediate plate 9 biased by the coil springs 9*a* together with the rotation of the rotating shaft 6 of the feeding roller 3 is constituted by the cams 11 and the pressure-contact portions 9*b* of the intermediate plate 9.

Additionally, a sheet feed tooth-missing stage gear 12 that is a tooth-missing gear having a tooth-missing portion is fixed to the outside of one cam 11 of the rotating shaft 6. In addition, the sheet feed tooth-missing stage gear 12 is regulated in rotation by the solenoid 14, and meshes with an input stage gear 13 fixed to an input shaft 13*a* to which a rotational driving force is transmitted via the driving transmission unit from the main motor M if the regulation by the solenoid 14 released.

Here, the input stage gear 13 that is a driving gear, as illustrated in FIGS. 3A to 3H, is a stage gear integrally having a large gear 13*b* that is a large driving gear, and a small gear 13*c* that is a small driving gear, and rotates in a direction of R2 at a constant speed integrally with the input shaft 13*a*. Additionally, the sheet feed tooth-missing stage gear 12 has a tooth-missing large gear 12*a*, a cam face 12*b*, and a tooth-missing small gear 12*c*. In the present exemplary embodiment, a variable speed unit 19 that is provided between the main motor M and the lifting and lowering unit 11A and that is constituted by the input stage gear 13 and the sheet feed tooth-missing stage gear 12 changes the rotating speed of the rotating shaft 6 from a first speed to a second speed faster than the first speed. This changes the rotating speed of the feeding roller 3 and the ascending speed of the intermediate plate 9. That is, the variable speed unit 19 has a function as a driving transmission unit that transmits driving from the main motor M to the lifting and lowering unit 11A.

In addition, in FIGS. 3A to 3H, reference numeral 15 represents a sheet feed gear spring of which one end is locked to a locking portion 12*e* formed on the side surface of the tooth-missing small gear 12*c* of the sheet feed tooth-missing stage gear 12 and the other end is locked to a fixed shaft 27 provided at a frame (not illustrated) of the printer body 1A. Then, the sheet feed tooth-missing stage gear 12 is biased by the sheet feed gear spring 15 that constitutes a gear biasing unit so as to rotate in a direction of R1, that is, in a direction in which the feeding roller 3 is rotated in the sheet feeding direction.

Figure 3A:
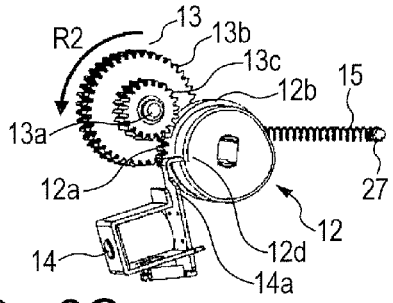
FIGS. 3A, 3B, 3C, 3D, 3E, 3F, 3G and 3H are first views illustrating the sheet feeding operation of the sheet feeding apparatus related to the first exemplary embodiment of the invention.
Figure 3B:
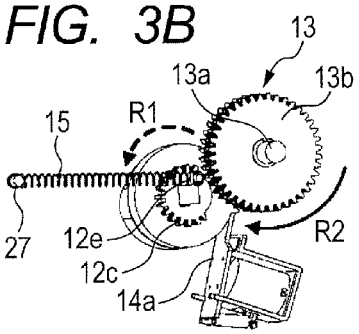

FIG. 3A, and FIG. 3B, which is a view when FIG. 3A is viewed from the input stage gear 13 side, illustrate a state before sheet feeding operation is started. At this time, the tooth-missing large gear 12*a* and tooth-missing small gear 12*c* of the sheet feed tooth-missing stage gear 12 do not mesh with the large gear 13*b* and small gear 13*c* of the input stage gear 13.

In addition, although a rotative force in the direction of R1 illustrated by a broken line is applied to the sheet feed tooth-missing stage gear 12 by the tension of the sheet feed gear spring 15, as illustrated in FIG. 3A, a locking claw 14*a* of the solenoid 14 is locked to a stepped portion 12*d* of the sheet feed tooth-missing stage gear 12. Thereby, the sheet feed tooth-missing stage gear 12 is held in a state where the tooth-missing large gear 12*a* and the tooth-missing small gear 12*c* do not mesh with the large gear 13*b* and small gear 13*c* of the input stage gear 13, that is, a stop (sheet feed standby) state.

Figure 4A:
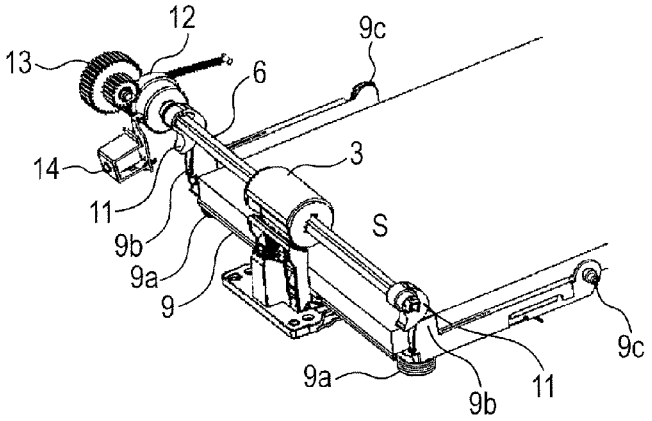
FIGS. 4A, 4B and 4C are second views illustrating the sheet feeding operation of the sheet feeding apparatus related to the first exemplary embodiment of the invention.

Additionally, FIG. 4A illustrates a state where the intermediate plate 9 is at an initial position before sheet feeding. At this time, the pressure-contact portions 9*b* of the intermediate plate 9 are depressed by the cams 11 about the fulcrums 9*c* while compressing the coil spring 9*a*, and thereby, the tip portion of a sheet S on the intermediate plate 9 is spaced apart from the feeding roller 3.

Figure 3C:
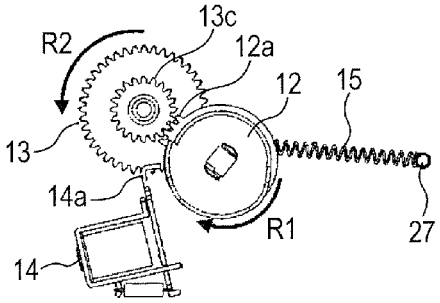
Figure 3D:
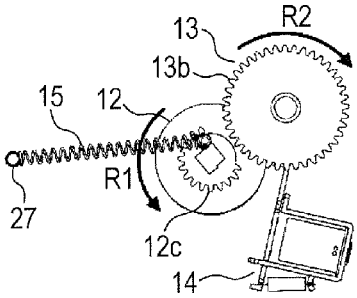
Figure 4B:
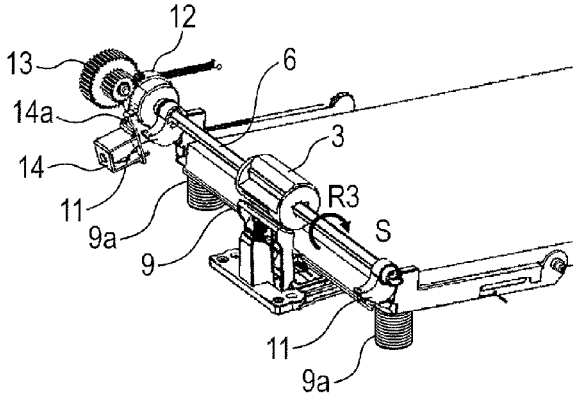

Next, if the sheet feeding operation is started, the control unit 50 turns on the solenoid 14, and as illustrated in FIG. 4B, releases the locking of the locking claw 14*a*. Thereby, as illustrated in FIGS. 3C and 3D, the sheet feed tooth-missing stage gear 12 starts rotation in the direction of R1 by the tension of the sheet feed gear spring 15. Then, the tooth-missing large gear 12*a* of the sheet feed tooth-missing stage gear 12 meshes with the small gear 13*c* of the input stage gear 13 that receives the driving of the main motor M and is rotationally driven in the direction of arrow R2.

Then, as the tooth-missing large gear 12*a* of the sheet feed tooth-missing stage gear 12 meshes with the small gear 13*c* of the input stage gear 13 in this way, as illustrated in FIG. 4B, the rotational driving in a direction of arrow R3 is transmitted to the rotating shaft 6, and the cams 11 rotate at a predetermined angle. At this time, since the tooth-missing large gear 12*a* of the sheet feed tooth-missing stage gear 12 meshes with the small gear 13*c* of the input stage gear 13, the sheet feed tooth-missing stage gear 12 and the cams 11 rotate slowly with respect to the rotation of the input stage gear 13. That is, the rotating shaft 6 and the cams 11 rotate at the first speed that is a relatively slow speed. Then, if the cams 11 rotate slowly in this way, the coil springs 9*a* compressed by the cams 11 are slowly opened. Thus, the intermediate plate 9 also ascends while the speed thereof is reduced, and the sheet S on the intermediate plate 9 slowly abuts against the feeding roller 3. As a result, the collision sound when the sheet S abuts against the feeding roller 3 decreases.

In addition, at this time, as illustrated in FIG. 3D, the large gear 13*b* of the input stage gear 13 and the tooth-missing small gear 12*c* of the sheet feed tooth-missing stage gear 12 do not mesh with each other yet. Additionally, if the sheet feed tooth-missing stage gear 12 starts rotation, the solenoid 14 is turned off. Thereby, the locking claw 14*a* is returned and abuts on the cam face 12*b* of the sheet feed tooth-missing stage gear 12, and then, locks the stepped portion 12*d* and locks the sheet feed tooth-missing stage gear 12 again when the stepped portion 12*d* has turned.

Figure 3E:
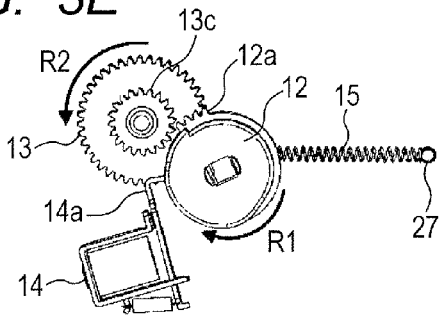
Figure 3F:
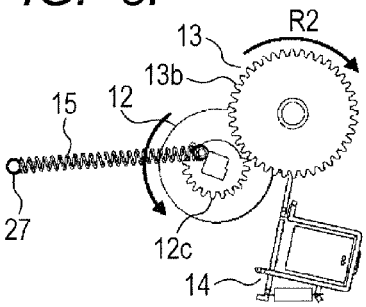

Next, if the intermediate plate 9 ascends, as illustrated in FIG. 3E, the meshing between the tooth-missing large gear 12*a* of the sheet feed tooth-missing stage gear 12 and the small gear 13*c* of the input stage gear 13 is completed. In addition, at this time, as illustrated in FIG. 3F, the tooth-missing small gear 12*c* of the sheet feed tooth-missing stage gear 12 and the large gear 13*b* of the input stage gear 13 does not mesh with each other yet.

Figure 4C:
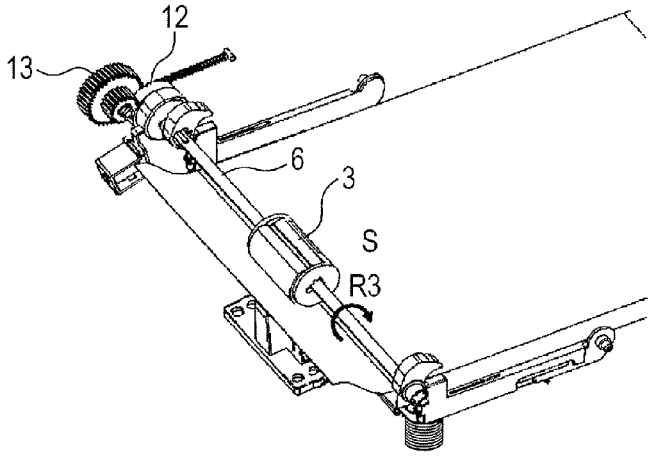

Here, at this time, since the sheet feed gear spring 15 exerts tension still in an extended state, then, the sheet feed tooth-missing stage gear 12 continues being rotated by the sheet feed gear spring 15, and the tooth-missing small gear 12*c* of the sheet feed tooth-missing stage gear 12 meshes with the large gear 13*b* of the input stage gear 13 eventually. Thereby, as illustrated in FIG. 4C, a rotative force is transmitted to the rotating shaft 6 again.

Here, in a case where the tooth-missing small gear 12*c* of the sheet feed tooth-missing stage gear 12 meshes with the large gear 13*b* of the input stage gear 13 in this way, the sheet feed tooth-missing stage gear 12 rotates fast with respect to the rotating speed of the input stage gear 13. Namely, the rotating shaft 6 and the feeding roller 3 rotate at the second speed faster than the first speed. In addition, in the present exemplary embodiment, the rotating speed of the sheet feed tooth-missing stage gear 12 at this time is equal to the process speed of the printer body 1A. Then, after only one top sheet fed out by the feeding roller 3 that rotates at such a rotating speed is separated by the separation pad 10 and the feeding roller 3 that are illustrated in FIG. 2, the top sheet is fed out to the conveying roller pair 4 at a process speed by the feeding roller 3 and conveyed toward the image forming unit 5.

Figure 5A:
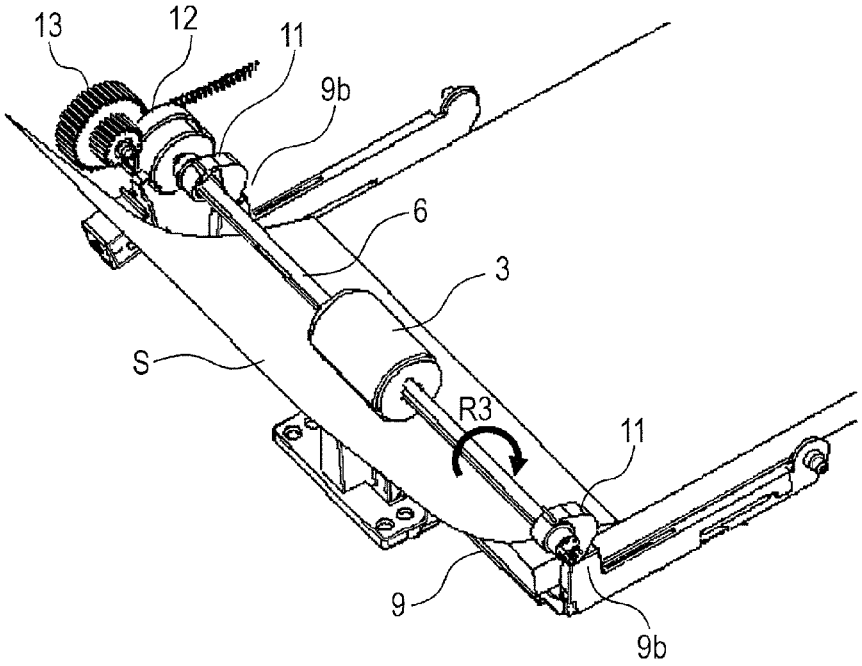
FIGS. 5A and 5B are third views illustrating the sheet feeding operation of the sheet feeding apparatus related to the first exemplary embodiment of the invention.
Figure 5B:
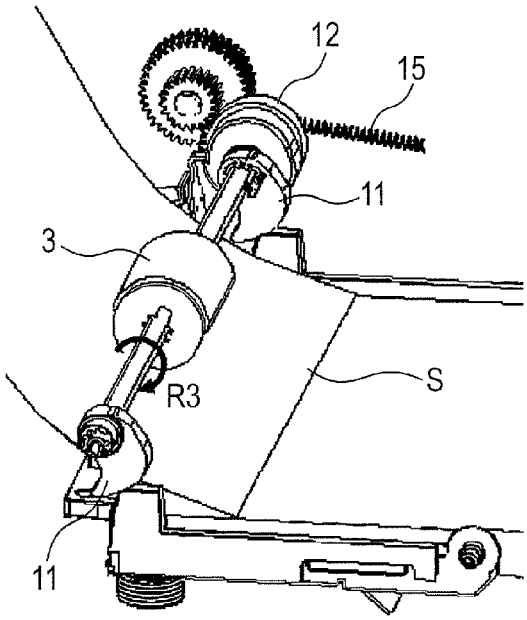

Next, if the separation work of the sheet S by the feeding roller 3 and the separation pad 10 ends and the sheet S is passed to the conveying roller pair 4 after the fed-out sheet has reached the conveying roller pair 4, as illustrated in FIGS. 5A and 5B, the cams 11 presses the pressure-contact portions 9*b* of the intermediate plate 9 downward. Thereby, the intermediate plate 9 descends and the sheet S on the intermediate plate is spaced apart from the feeding roller 3.

Figure 3G:
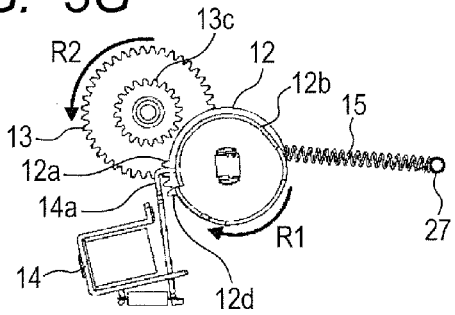
Figure 3H:
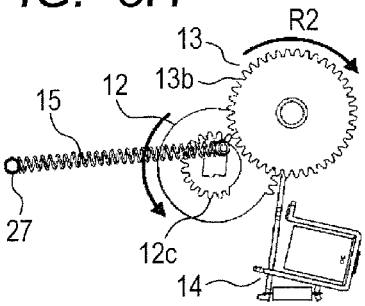

Thereafter, if the sheet feed tooth-missing stage gear 12, as illustrated in FIG. 3H, rotates to a position where the meshing between the large gear 13*b* of the input stage gear 13 and the tooth-missing small gear 13*c* of the sheet feed tooth-missing stage gear 12 ends, a rotational driving force is no longer transmitted to the sheet feed tooth-missing stage gear 12. In addition, at this time, as illustrated in FIG. 3G, the small gear 13*c* of the input stage gear 13 and the tooth-missing large gear 12*a* of the sheet feed tooth-missing stage gear 12 does not mesh with each other.

However, even in a case where the rotational driving force of the sheet feed tooth-missing stage gear 12 is lost in this way, the sheet feed gear spring 15 is still in an extended state. For this reason, thereafter, the sheet feed tooth-missing stage gear 12 rotates in the direction of R1 by the tension of the sheet feed gear spring 15, and the small gear 13*c* of the input stage gear 13 and the tooth-missing large gear 12*a* of the sheet feed tooth-missing stage gear 12 meshes with each other. Thereby, the sheet feed tooth-missing stage gear 12 rotates, and eventually returns to the same initial position as FIG. 3A. At this time, the sheet feed tooth-missing stage gear 12 does not mesh with the input stage gear 13, and is locked by the locking claw 14*a* of the solenoid 14 while receiving tension in the direction of R1 by the sheet feed gear spring 15.

Incidentally, when a continuous printing job of a plurality of sheets is received, the sheet-to-sheet setting between a preceding sheet and a subsequent sheet may become short. In this case, as illustrated in FIG. 4B, the feeding operation of the following sheet begins while the rear end of the preceding sheet still remains within the sheet feeding apparatus when the sheet feed tooth-missing stage gear 12 and the cams 11 have returned to their initial positions. At this time, the sheet S and the feeding roller 3 are spaced apart from each other and the feeding roller 3 and the separation pad 10 do not abut against each other. For this reason, the preceding sheet is fed out by the conveying force of the conveying roller pair 4, and when the next sheet abuts against the feeding roller 3 and the feeding operation by the feeding roller 3 begins, the rear end of the preceding sheet comes out of a feeding unit.

Figure 6:
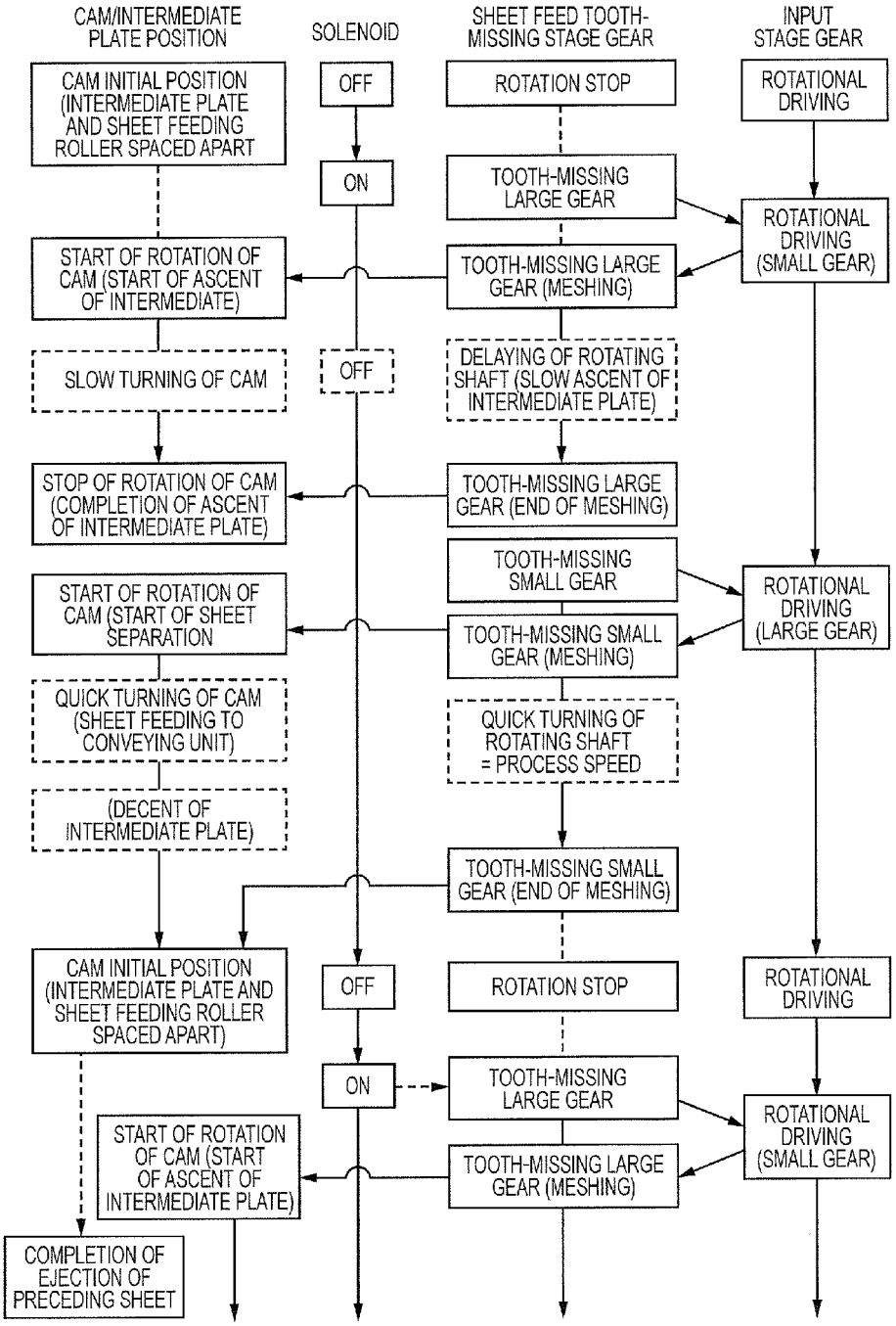
FIG. 6 is a view illustrating the flow of the sheet feeding operation of the sheet feeding apparatus related to the first exemplary embodiment of the invention.

In addition, FIG. 6 is a view illustrating the flow of the sheet feeding operation of the sheet feeding apparatus 1B related to the present exemplary embodiment, using the positions of the cams 11 and the intermediate plate (sheet), ON and OFF of the solenoid 14, and the rotation of the sheet feed tooth-missing stage gear 12 and the input stage gear 13. Additionally FIG. 7 is a view illustrating respective timings of the meshing of the solenoid 14 and the gears 12 and 13, the rotation of the cams 11, the ascent and descent of the intermediate plate 9, and the sheet feeding in accordance with the advance by the rotation of the cams 11.

Figure 7:
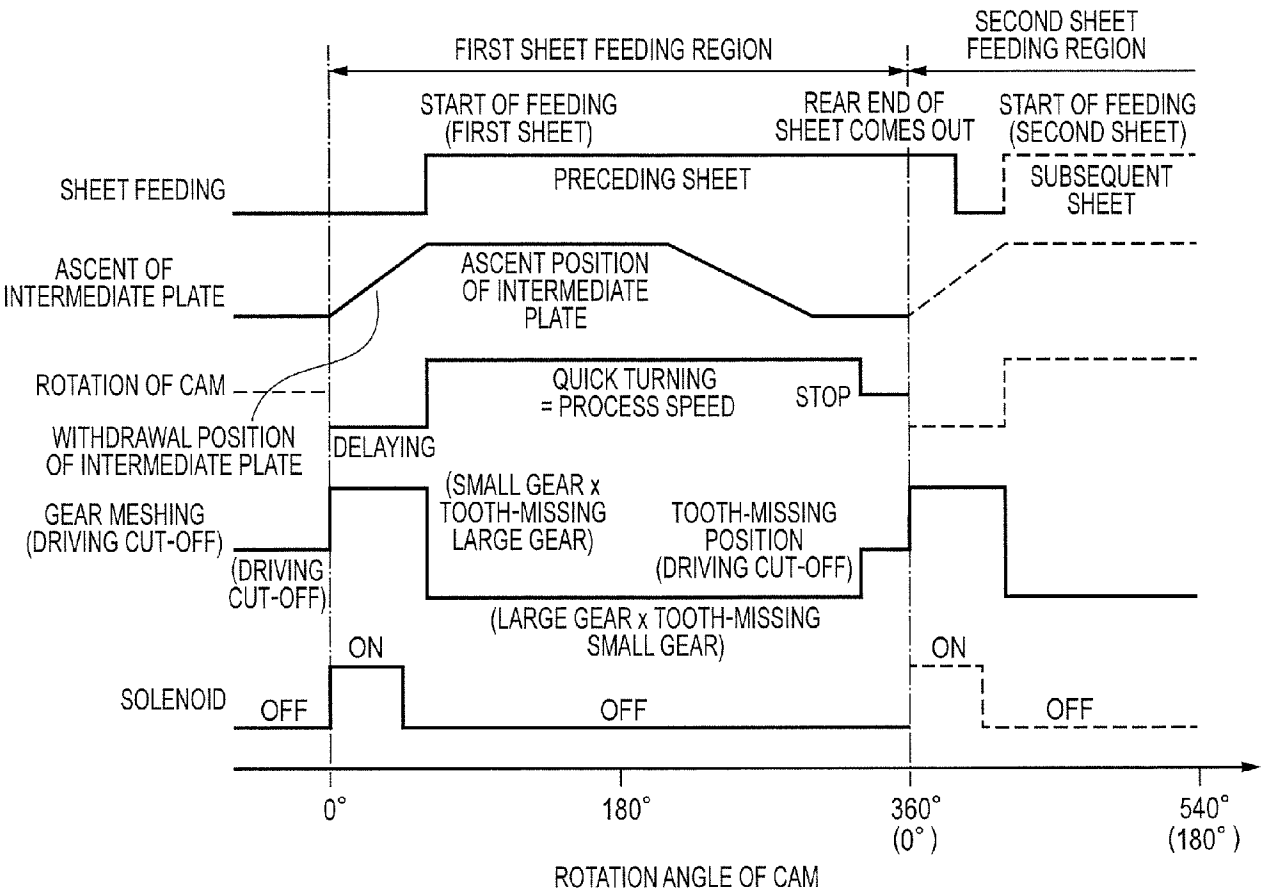
FIG. 7 is a view illustrating the timing of the sheet feeding operation of the sheet feeding apparatus related to the first exemplary embodiment of the invention.

If the schematic view of FIG. 6 is described in order from the top and the timing chart of FIG. 7 is described in order from the position of a cam rotation angle of 0° to the right, the tooth-missing large gear 12*a* of the sheet feed tooth-missing stage gear 12 meshes with the small gear 13*c* of the input stage gear 13, with the operation (ON) of the solenoid 14 as a start. In addition, at this time, the input stage gear 13 is always rotated. Then, if the tooth-missing large gear 12*a* of the sheet feed tooth-missing stage gear 12 meshes with the small gear 13*c* of the input stage gear 13 in this way, the cams 11 turn slowly to delay the rotating shaft 6. Thereby, the intermediate plate 9 ascends slowly.

Next, if the pressure contact between the cams 11 and the pressure-contact portions 9*b* of the intermediate plate 9 is released and the intermediate plate 9 that has ascended reaches a sheet feed separation position where the feeding of a sheet by the feeding roller 3 is allowed, the meshing of the tooth-missing large gear 12*a* of the sheet feed tooth-missing stage gear 12 with the small gear 13*c* of the input stage gear 13 is completed. Thereby, the rotation of the cams 11 stops and, the ascent of the intermediate plate 9 is completed correspondingly. Thereafter, switching to the meshing between the tooth-missing small gear 12*c* of the sheet feed tooth-missing stage gear 12 and the large gear 13*b* of the input stage gear 13 is made. Thereby, the cams 11 starts rotating, and the cams 11 and the rotating shaft 6 are quickly turned.

Thereby, the feeding roller 3 separates the top sheet at a predetermined process speed and feeds out the sheet to the conveying roller pair 4, and the intermediate plate 9 descends. Moreover, if the cams 11 rotate to depress the intermediate plate 9, the sheet feed tooth-missing stage gear 12 reaches a tooth-missing position to end the meshing, the driving from the input stage gear 13 is cut off, and the cams 11 and the intermediate plate 9 return to their initial positions. In addition, FIGS. 6 and 7 illustrates the timing when the next feeding operation is started before the rear end of a preceding sheet comes out of a sheet feeding unit in a case where a continuous printing job of a plurality of sheets is received and the sheet-to-sheet setting between the preceding sheet and the subsequent sheet is shortened.

As described above, in the present exemplary embodiment, if the sheet feeding operation is started, first, the sheet feed tooth-missing stage gear 12 and the input stage gear 13 are made to mesh with each other so as to be a reduction ratio in which the rotating speed of the cams 11 becomes slow. Additionally, during the separation of a sheet by the feeding roller 3 and the feeding-out of the sheet to the conveying roller pair 4, the sheet feed tooth-missing stage gear 12 and the input stage gear 13 are made to mesh with each other in a reduction ratio such that the feeding roller 3 is rotated at a predetermined process speed.

By setting the rotating speed of the rotating shaft 6 and the cams 11 during the ascent of the intermediate plate to the relatively slow first speed in this way, the ascending speed of the intermediate plate 9 can be slowed down, and as a result, the collision sound when the sheet on the intermediate plate abuts against the feeding roller 3 can be reduced. Additionally, during the separation feeding operation of a sheet, the feeding roller 3 can be rotated at a predetermined process speed by increasing the rotating speed of the rotating shaft 6 and the feeding roller 3 to the second speed faster than the first speed.

That is, in the present exemplary embodiment, the ascending speed of the intermediate plate 9 that ascends by one rotational driving of the cams 11 (input stage gear 13) can be slowed down by making the sheet feed tooth-missing stage gear 12 to mesh with the input stage gear 13 that rotates at a constant speed. Thereby, even in a case where an independent driving source is not provided or a driving source that can supply only constant-speed rotational driving is provided, the collision sound when a sheet on the intermediate plate abuts against the feeding roller 3 can be reduced, and a sheet feeding apparatus having excellent silence can be provided.

Figure 8A:
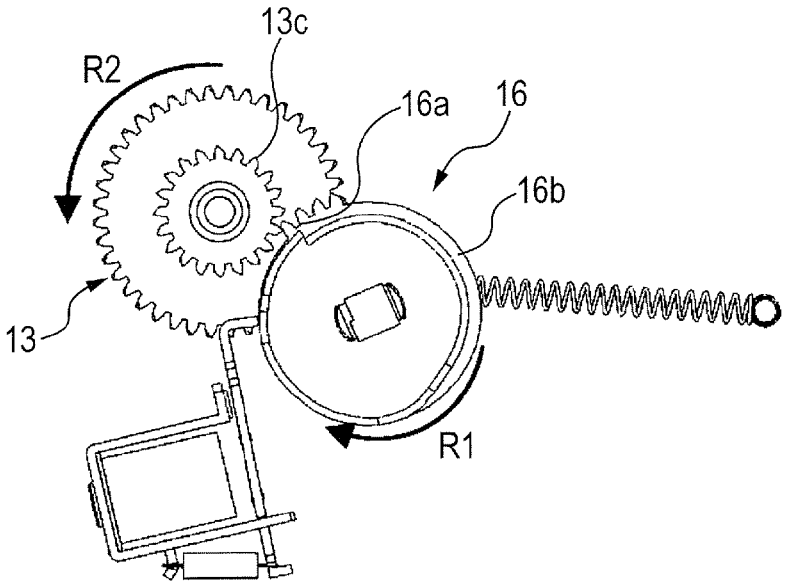
FIGS. 8A and 8B are views illustrating the configuration of a sheet feeding apparatus related to a second exemplary embodiment of the invention.
Figure 8B:
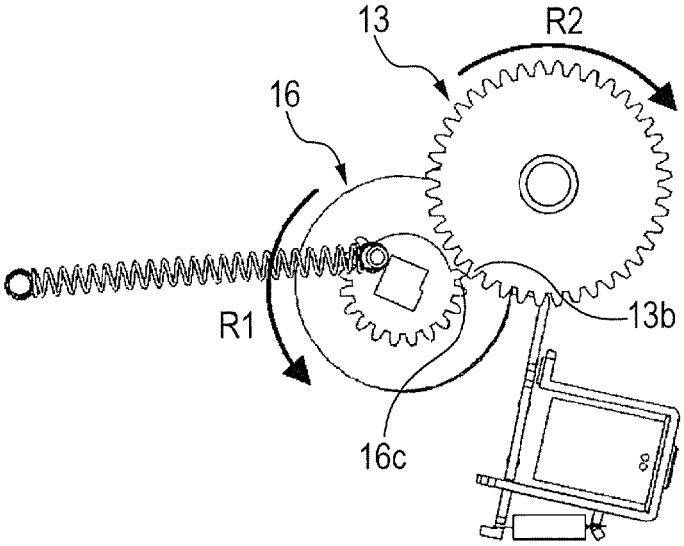

Next, a second exemplary embodiment of the invention will be described. FIGS. 8A and 8B are views illustrating the configuration of a sheet feeding apparatus related to the present exemplary embodiment of the invention. In addition, in the present exemplary embodiment, the same reference numerals as FIGS. 3A to 3H represent the same or equivalent portions.

In FIGS. 8A and 8B, reference numeral 16 represents a sheet feed tooth-missing stage gear, and the sheet feed tooth-missing stage gear 16 includes a tooth-missing large gear 16*a*, a cam face 16*b*, and a tooth-missing small gear 16*c*. In addition, FIGS. 8A and 8B illustrates the moment when the intermediate plate 9 ascends, the meshing between the small gear 13*c* of the input stage gear 13 and the tooth-missing large gear 16*a* of the sheet feed tooth-missing stage gear 16 ends and meshing is switched to the large gear 13*b* of the input stage gear 13 and the tooth-missing small gear 16*c* of the sheet feed tooth-missing stage gear 16.

Here, in the present exemplary embodiment, the input stage gear 13 has such a relationship that the phase of the meshing end of the small gear 13*c* and the phase of the meshing start of the large gear 13*b* coincide with each other. For example, in a case where the module of a gear is 1, the switching phase of the meshing of the large gear 13*b* and the small gear 13*c* with the sheet feed tooth-missing stage gear 16 is set after the number of teeth of the large gear 13*b* is set so as to become an integral multiple of the number of teeth of the small gear 13*c*.

On the other hand, the tooth-missing large gear 16*a* and tooth-missing small gear 16*c* of the sheet feed tooth-missing gear 16 that mesh with the input stage gear 13 also have the same relationship. Moreover, the sheet feed tooth-missing gear 16 is arranged so that the phase of the meshing end of the tooth-missing large gear 16*a* the phase of the meshing start of the tooth-missing small gear 16*c* match each other, and switches meshing from the tooth-missing large gear 16*a* to the tooth-missing small gear 16*c*.

In this way, in the present exemplary embodiment, the phases and mutual meshing phases of each large gear and each small gear are matched when the meshing between the input stage gear 13 and the sheet feed tooth-missing stage gear 16 is switched. Thereby, if the meshing between the small gear 13*c* of the input stage gear 13 and the tooth-missing large gear 16*a* of the sheet feed tooth-missing stage gear 16 ends, the tooth-missing small gear 16*c* of the sheet feed tooth-missing stage gear 16 can be made to mesh with the large gear 13*b* of the input stage gear 13. By adopting such a configuration, the switching of meshing between the tooth-missing gear 16*a* or 16*c* of the sheet feed tooth-missing stage gear 16 and the gear 13*b* or 13*c* of the input stage gear 13 is allowed without using a sheet feed gear spring that has a large spring force.

Figure 9A:
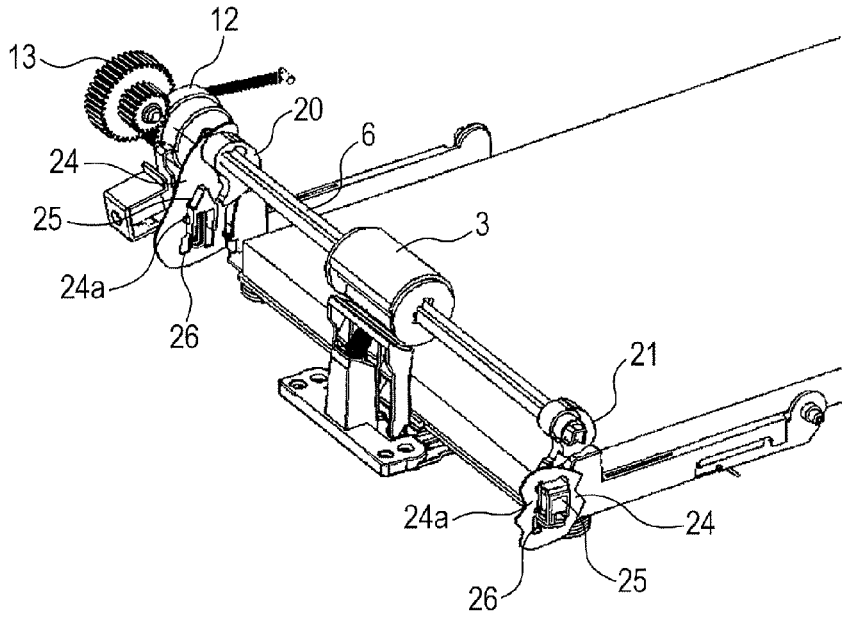
FIGS. 9A and 9B are views illustrating the configuration of a sheet feeding apparatus related to a third exemplary embodiment of the invention.
Figure 9B:
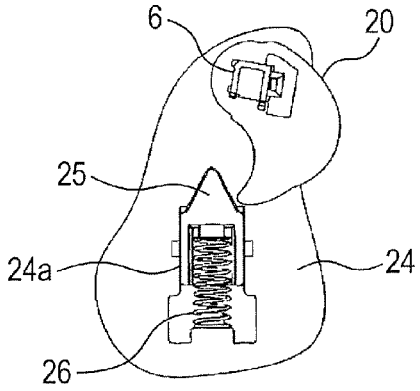

Next, a third exemplary embodiment of the invention will be described. FIGS. 9A and 9B are views illustrating the configuration of a sheet feeding apparatus related to the present exemplary embodiment of the invention. In addition, in the present exemplary embodiment, the same reference numerals as FIGS. 3A to 3H represent the same or equivalent portions.

In FIGS. 9A and 9B, reference numerals 20 and 21 represent cams with a symmetrical shape provided at both ends of the rotating shaft 6, reference numeral 25 represents cam pressing members that presses the cams 20 and 21, and reference numeral 24 represents side plates that hold the rotating shaft 6 and supports the cam pressing members 25 to be vertically movable. The side plate 24, as illustrated in FIG. 9A, is provided with a guide hole 24*a* for allowing the cam pressing member 25 to be vertically movable, and a spring 26 that biases the cam pressing member 25 upward.

Figure 10A:
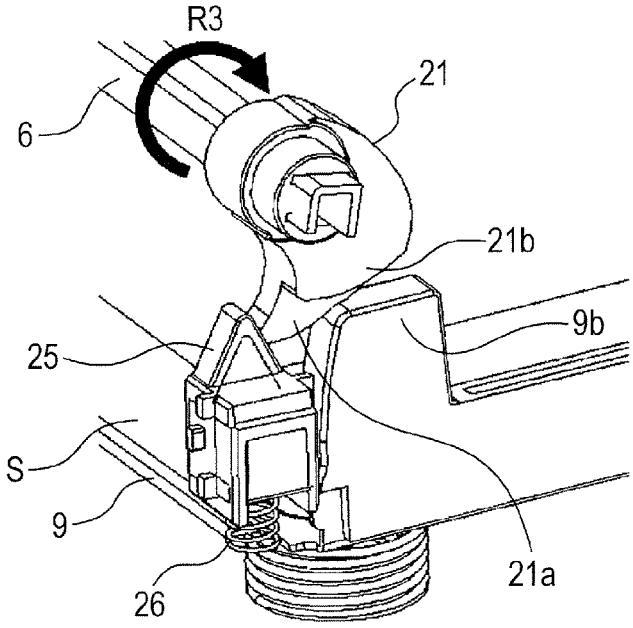
FIGS. 10A and 10B are views illustrating the sheet feeding operation of the sheet feeding apparatus related to the third exemplary embodiment of the invention.
Figure 10B:
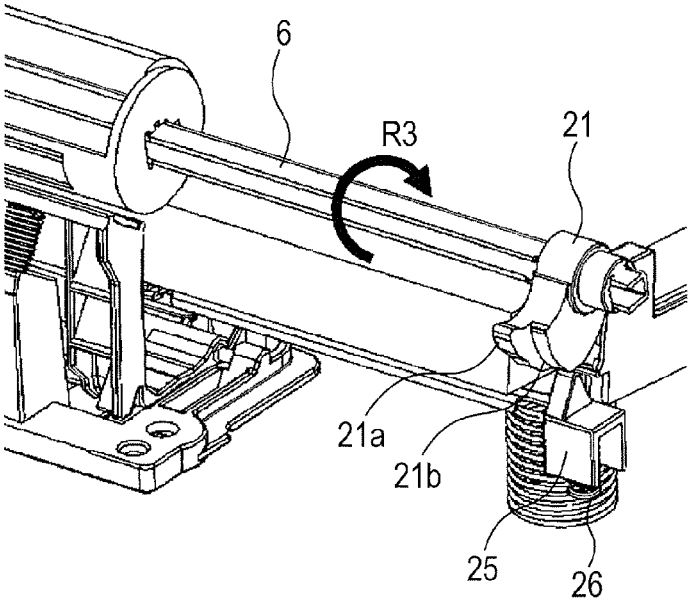

Here, the cam 21, as illustrated in FIGS. 10A and 10B, includes a first cam face 21*a* that abuts against the pressure-contact portion 9*b* of the intermediate plate 9 with the rotation of the rotating shaft 6 in the direction of R3, and a second cam face 21*b* that is an abutting portion that abuts against the cam pressing member 25 and lifts and lowers the cam pressing member 25. In addition, the cam 21 also has the same configuration.

Then, if the rotating shaft 6 rotates and the cam 21 rotate, first, as illustrated in FIG. 10A, the intermediate plate 9 ascends while making the pressure-contact portion 9*b* abut against the first cam face 21*a*. In addition, at this time, the second cam face 21*b* does not abut against the cam pressing member 25. However, if the intermediate plate 9 ascends further, the second cam face 21*b* abuts against the cam pressing member 25. Then, when the intermediate plate 9 has ascended, as illustrated in FIG. 10B, the second cam face 21*b* depresses the cam pressing member 25 while compressing the spring 26 downward.

Next, if the cam 21 rotates further, the cam pressing member 25 passes through the deflection point of the second cam face 21*b*. In this case, the compressive force of the spring 26 is opened, and thereby, the cam 21 is pressed in a direction in which the cam further continues its rotation via the second cam face 21*b*, and urges the rotation of the rotating shaft 6. Here, the meshing state between the input stage gear 13 and the sheet feed tooth-missing gear 12 at this time is the same as FIG. 3E, and the input stage gear 13 and the sheet feed tooth-missing gear 12 do not mesh with each other.

In addition, in the present exemplary embodiment, when the tooth-missing large gear 12*a* of the sheet feed tooth-missing stage gear 12 that meshes with the small gear 13*c* of the input stage gear 13 has ended its meshing, as illustrated in FIG. 10B, the intermediate plate 9 is at a lifted position. Additionally, at this time, as illustrated in FIG. 3F, the tooth-missing small gear 12*c* of the sheet feed tooth-missing stage gear 12 that meshes with the large gear 13*b* of the input stage gear 13 next is at a position (phase) that the tooth-missing portion faces the large gear 13*b*, and the rotation from the input stage gear 13 is not transmitted to the sheet feed tooth-missing stage gear 12.

However, in the present exemplary embodiment, as illustrated in FIG. 10B, the cam pressing member 25 pushes up the second cam face 21*b* of the cam 21 in the rotational direction. Thereby, the rotating shaft 6 can be rotated, and as a result, a toothed portion of the tooth-missing small gear 12*c* of the sheet feed tooth-missing stage gear 12 can be made to mesh with the large gear 13*b* of the input stage gear 13.

In this way, in the present exemplary embodiment, after the intermediate plate 9 has ascended, the cams 20 and 21 are rotated by the cam pressing members 25, and the tooth-missing small gear 16*c* of the sheet feed tooth-missing stage gear 16 is made to mesh with the large gear 13*b* of the input stage gear 13. Thereby, the tooth-missing small gear 16*c* of the sheet feed tooth-missing stage gear 16 can be made to mesh with the large gear 13*b* of the input stage gear 13.

In this way, in the present exemplary embodiment, the cams 20 and 21 are rotated by the cam pressing members 25 after the intermediate plate 9 has ascended. Thereby, if the meshing between the small gear 13*c* of the input stage gear 13 and the tooth-missing large gear 16*a* of the sheet feed tooth-missing stage gear 16 ends, the tooth-missing small gear 16*c* of the sheet feed tooth-missing stage gear 16 can be made to mesh with the large gear 13*b* of the input stage gear 13. By adopting such a configuration, the switching of meshing between the tooth-missing gear 16*a* or 16*c* of the sheet feed tooth-missing stage gear 16 and the gear 13*b* or 13*c* of the input stage gear 13 is allowed without using a sheet feed gear spring that has a large spring force.

The present invention is also realized by execution of the following process. That is a process in which software (program) for realizing the functions of the embodiment is supplied to a system or an apparatus through a network or various storage media, and a computer (or CPU or MPU) of the system or the apparatus reads and executes the program.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-086032, filed Apr. 5, 2012, which is hereby incorporated by reference herein in its entirety.

REFERENCE SIGNS LIST

1: printer
1A: printer body
3: feeding roller
5: image forming unit
1B: sheet feeding apparatus
6: rotating shaft
9: intermediate plate
9*a*: coil spring
9*b*: pressure-contact portion
11: cam
11A: lifting and lowering unit
12: sheet feed tooth-missing stage gear
12*a*: tooth-missing large gear
12*c*: tooth-missing small gear
13: input stage gear
13*b*: large gear
13*c*: small gear
14: solenoid
15: sheet feed gear spring
16: sheet feed tooth-missing stage gear
16*a*: tooth-missing large gear
16*c*: tooth-missing small gear
19: variable speed unit
20, 21: cam
25: cam pressing member
50: control unit
M: main motor
S: sheet

The invention claimed is:

1. A sheet feeding apparatus comprising:

a liftable sheet stacking plate that supports a sheet;

a feeding roller that is provided above the sheet stacking plate and feeds the sheet supported by the sheet stacking plate;

a biasing unit that biases the sheet stacking plate in a direction of the feeding roller to press the sheet stacked on the sheet stacking plate against the feeding roller;

a drive unit that generates a driving force in order to rotate a shaft of the feeding roller;

a lifting and lowering unit that has a cam provided on the shaft of the feeding roller and a pressure-contact portion that is provided at the sheet stacking plate and is brought into pressure contact with the cam and that lifts and lowers the sheet stacking plate biased by the biasing unit with the rotation of the shaft of the feeding roller while bringing the pressure-contact portion into pressure contact with the cam; and a variable speed unit that changes the rotating speed of the shaft of the feeding roller that rotates under the driving of the drive unit, wherein the variable speed unit rotates the shaft of the feeding roller at a first speed to lift the sheet stacking plate, and rotates the shaft of the feeding roller at a second speed faster than the first speed if the sheet stacked on the sheet stacking plate abuts against the feeding roller, wherein the variable speed unit includes a driving gear that is fixed to an input shaft driven and rotated by the drive unit and that has a first driving gear and a second driving gear larger than the first driving gear, and a tooth-missing gear that is fixed to the shaft of the feeding roller and that has a first tooth-missing gear and a second tooth-missing gear larger than the first tooth-missing gear, wherein the shaft of the feeding roller rotates at the first speed as the first driving gear that is driven and rotated by the drive unit meshes with the second tooth-missing gear, and rotates at the second speed as the second driving gear that is driven and rotated by the drive unit meshes with the first tooth-missing gear, and wherein the sheet feeding apparatus further comprises a gear biasing unit that biases the tooth-missing gear so as to rotate in a direction in which the feeding roller is rotated and that rotates the tooth-missing gear so that the second tooth-missing gear meshes with the first driving gear if the feeding of the sheet is started.

2. The sheet feeding apparatus according to claim 1, wherein the variable speed unit has a driving transmission unit that transmits the driving of the drive unit to the lifting and lowering unit.

3. The sheet feeding apparatus according to claim 1, wherein the drive unit rotates at a constant speed.

4. The sheet feeding apparatus according to claim 1, wherein the gear biasing unit rotates the tooth-missing gear so that the first tooth-missing gear meshes with the second driving gear after the meshing of the second tooth-missing gear with the first driving gear is completed.

5. The sheet feeding apparatus according to claim 1, wherein the first tooth-missing gear of the tooth-missing gear is provided so as to mesh with the second driving gear when the meshing of the second tooth-missing gear with the first driving gear by the gear biasing unit is completed.

6. The sheet feeding apparatus according to claim 1, further comprising:

a pressing portion that presses the cam when the meshing of the second tooth-missing gear with the first driving gear by the gear biasing unit is completed, and rotates the tooth-missing gear so that the first tooth-missing gear meshes with the second driving gear.

7. The sheet feeding apparatus according to claim 6, wherein the cam is provided with an abutting portion against which the pressing portion abuts if the meshing of the second tooth-missing of the tooth-missing gear with the first driving gear is completed and of which the abutment against the pressing portion is released if the first tooth-missing gear meshes with the second driving gear.

8. An image forming apparatus comprising:

an image forming unit that forms an image on a sheet; and the sheet feeding apparatus according to claim 1 that feeds the sheet to the image forming unit.

* * * * *